US008274398B2

(12) United States Patent
Zhang

(10) Patent No.: US 8,274,398 B2
(45) Date of Patent: Sep. 25, 2012

(54) USB FLASH DRIVE AND METHOD FOR DETERMINING AVAILABLE STORAGE CAPACITY OF THE USB FLASH DRIVE

(75) Inventor: Le Zhang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 423 days.

(21) Appl. No.: 12/730,258

(22) Filed: Mar. 24, 2010

(65) Prior Publication Data

US 2011/0148655 A1 Jun. 23, 2011

(30) Foreign Application Priority Data

Dec. 22, 2009 (CN) ..... 2009 1 0311996

(51) Int. Cl.
*G08B 5/00* (2006.01)
*G08B 5/24* (2006.01)

(52) U.S. Cl. ..... 340/815.86; 340/815.78; 340/815.4

(58) Field of Classification Search ..... 340/815.86
See application file for complete search history.

(56) References Cited

U.S. PATENT DOCUMENTS 6,816,071 B2 * 11/2004 Conti ..... 340/540
7,120,813 B2 * 10/2006 Leydier et al. ..... 713/400
7,221,306 B2 * 5/2007 Young ..... 341/173
7,683,801 B2 * 3/2010 Winarski ..... 340/815.4
7,762,470 B2 * 7/2010 Finn et al. ..... 235/492

FOREIGN PATENT DOCUMENTS

JP 2004326146 A * 11/2004

OTHER PUBLICATIONS http://usb.brando.com/prod_detail.php?prod_id=00354/ website accessed Jul. 16, 2012.*

* cited by examiner

*Primary Examiner* — Daniel Wu
*Assistant Examiner* — Emily C Terrell
(74) *Attorney, Agent, or Firm* — Altis Law Group, Inc.

(57) ABSTRACT

A Universal Serial Bus (USB) flash drive includes an USB interface, a control unit, a storage unit, a timer, a logic circuit, and a quartz meter that includes a scale dial and a dial pointer. The control unit calculates a storage capacity difference between a current storage capacity and a previous storage capacity, and calculates a runtime of the dial pointer according to a time calculation algorithm. The control unit generates an enabling signal if the storage capacity difference is not equal to zero, and generates an interrupt signal when the runtime equals the time value. The logic circuit outputs a high voltage to the quartz meter to control the dial pointer to run around the scale dial according to the enabling signal, and outputs a low voltage to the quartz meter to control the dial pointer to stop running around the scale dial according to the interrupt signal.

15 Claims, 4 Drawing Sheets

USB FLASH DRIVE AND METHOD FOR DETERMINING AVAILABLE STORAGE CAPACITY OF THE USB FLASH DRIVE

BACKGROUND

1. Technical Field

Embodiments of the present disclosure relate generally to flash memory drives, and more particularly to a Universal Serial Bus (USB) flash drive and a method for determining available storage capacity of the USB flash drive.

2. Description of Related Art

USB flash drives are very useful and convenient. When a user has multiple USB flash drives and wants to store data onto a USB drive, he/she must plug in one USB flash drive one at a time and check available memory of each of the USB drives to find one that can hold the data. This method is inconvenient and causes wear and tear on the both drive and the computer USB connection.

Accordingly, there is a need for an improved method for a method for determining available storage capacity of the USB flash drive, to overcome the above-mentioned problems.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
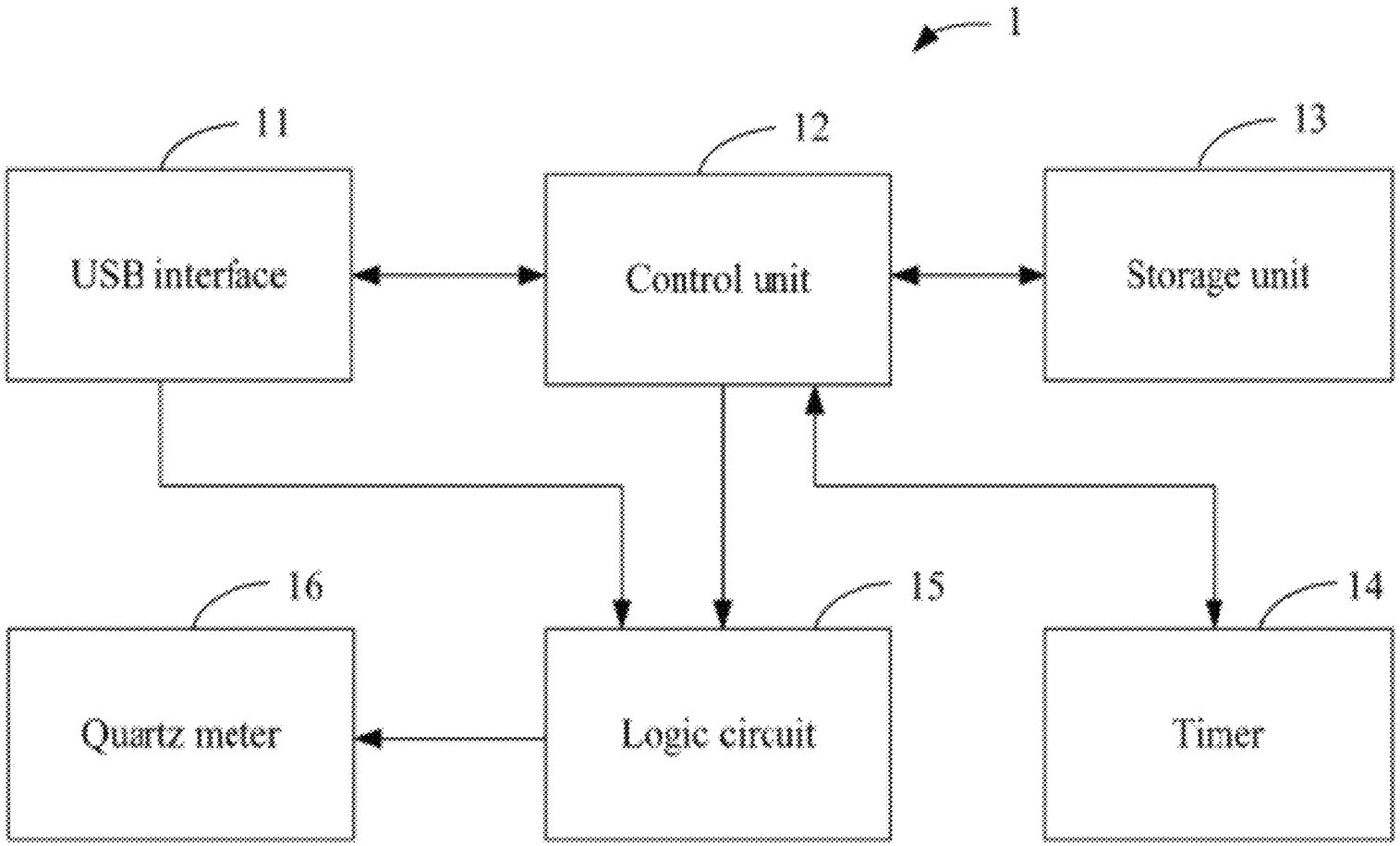
FIG. 1 is a schematic diagram of one embodiment of an interior structure of a USB flash drive.

FIG. 1 is a schematic diagram of one embodiment of an interior structure of a USB flash drive 1. It should be apparent that FIG. 1 is only one example of an architecture for the USB flash drive 1 that can be included with more or fewer components than shown, or a different configuration of the various components in other embodiments. In one embodiment, the computing device 1 includes a USB interface 11, a control unit 12, a storage unit 13, a timer 14, and a logic circuit 15, and a quartz meter 16. The USB interface 11 electronically connects to the control unit 12, and electronically connects to the logic circuit 15. The control unit 12 electronically connects to the storage unit 13, the timer 14, and the logic circuit 15. The logic circuit 15 electronically connects to the quartz meter 16.

Figure 2:
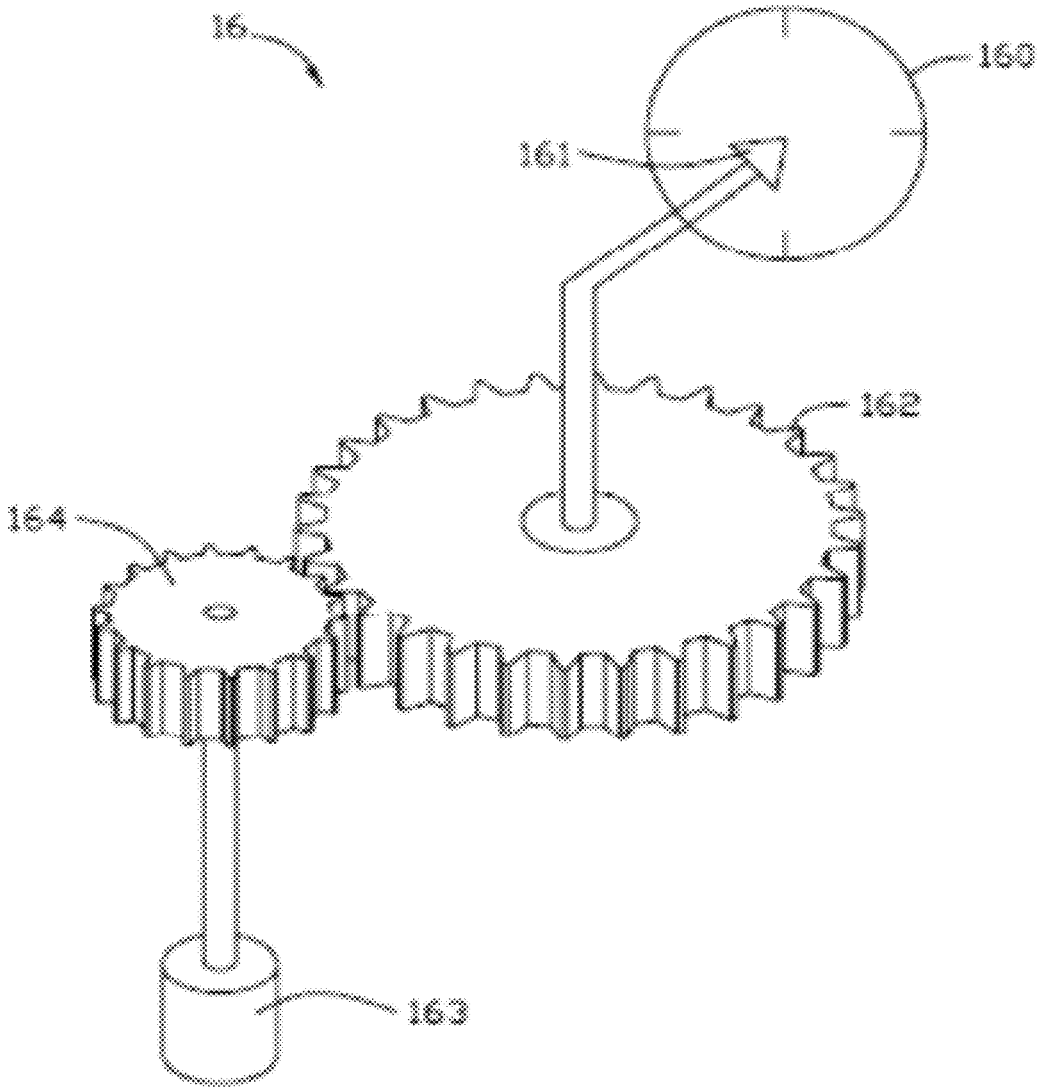
FIG. 2 is a schematic diagram of one embodiment of an interior structure of a quartz meter of the USB flash drive.
Figure 3:
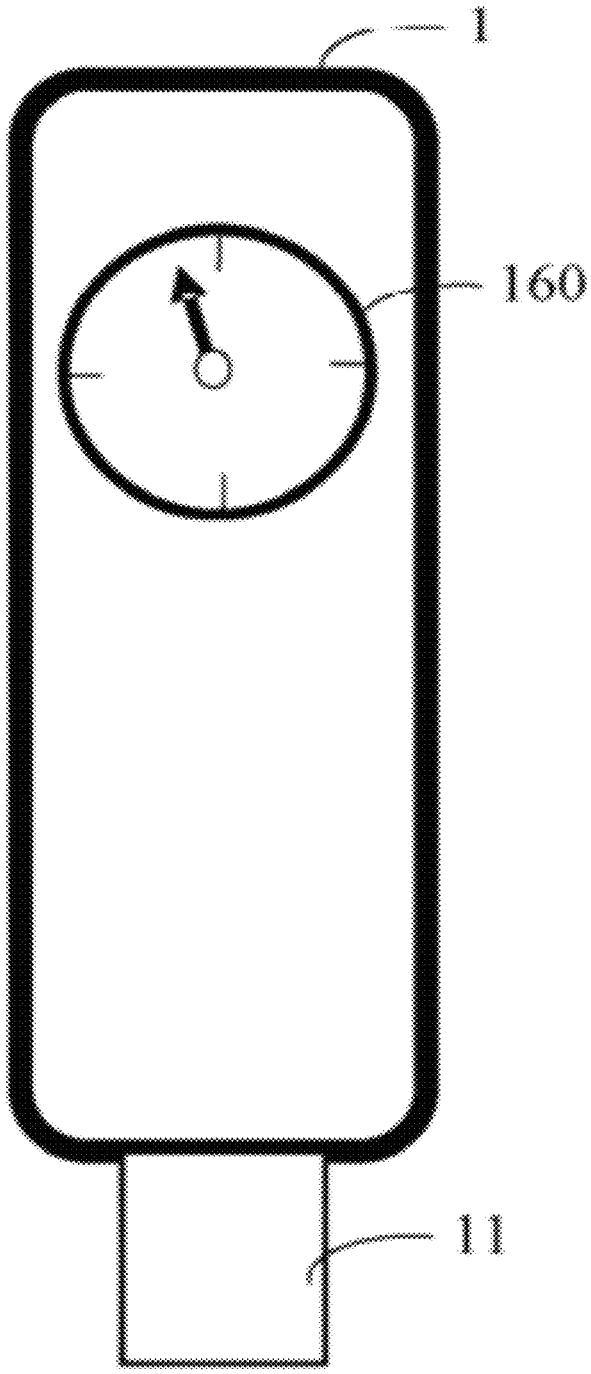
FIG. 3 is a schematic diagram of one embodiment of a quartz meter located on the surface of the USB flash drive.

FIG. 2 is a schematic diagram of one embodiment of an interior structure of the quartz meter 16. In the embodiment, the quartz meter 16 may include a scale dial 160, a dial pointer 161, a steering gear 162, a quartz resonator 163, and an electromagnetic rotor 164. The scale dial 160 can be positioned on the surface of the USB flash drive 1 (see FIG. 3), and includes a plurality of sequence of marks. Each of the marks corresponds to a storage capacity value of the USB flash drive 1, such as 0 gigabytes (GB), 0.25 GB, 0.5 GB, and 1.0 GB, for example. The quartz resonator 163 can generate a pulsed magnetic field when quartz resonator 163 is powered by a high voltage, such as 5 Volts. The quartz resonator 163 controls the electromagnetic rotor 164 to rotate 180 degrees per second under influence of the pulsed magnetic field. The dial pointer 161 can rotate to any mark on the scale dial 160 when the steering gear 162 is driven to rotate by the electromagnetic rotor 164.

The USB interface 11 can be plugged into a computing device, such as a personal computer (PC), or a digital camera, for example. The interface 11 is operable to transfer data between the USB flash drive 1 and the computer device when the USB interface 11 is connected to the computing device.

The storage unit 13 stores a file system for recording storage capacity information of the USB flash drive 1. In one embodiment, the file system may be a type of FAT16, FAT32, NTFS, EXT2 or EXT3 file system. The storage capacity information includes a current storage capacity, which is equal to the storage capacity of the USB flash drive 1 less the amount of memory currently in use. The storage capacity information also includes a previous storage capacity at the last use of the USB flash drive 1. The storage unit 13 may be a random access memory (RAM) for temporary storage of information, and/or a read only memory (ROM) for permanent storage of information.

The control unit 12 is operable to identify a type of the file system stored in the storage unit 13, and obtain the current storage capacity and the previous storage capacity of the USB flash drive 1 from the storage unit 13 according to the file system type. The control unit 12 calculates a storage capacity difference (denoted as "Ds") between the current storage capacity and the previous storage capacity of the USB flash drive 1, and determines whether the storage capacity difference is equal to zero.

The control unit 12 is further operable to generate an enabling signal for turning on the logical circuit 15 if the storage capacity difference is not equal to zero. The control unit 12 calculates a runtime (denoted as "Tr") of the dial pointer 161 according to a time calculation algorithm when the dial pointer 161 points to a mark of the scale dial 160 corresponding to the current storage capacity of the USB flash drive 1. In one embodiment, if the total storage capacity of the USB flash drive 1 is 1 GB, the time calculation algorithm is described as follows. Assuming that a reference storage capacity (denoted as "Rs") is represented as Rs=1 GB/360 degrees, the dial pointer 161 runs a reference mark (e.g., 5 marks) around the scale dial 160 when the electromagnetic rotor 164 rotates 180 degrees per second under the pulsed magnetic field. The control unit 12 calculates a rotation degree (denoted as "Dr") of the dial pointer 161, and determines whether the storage capacity difference is a positive value or a negative value. If the storage capacity difference is a positive value, the control unit 12 calculates the rotation degree as a absolute value of the storage capacity difference divided by the reference storage capacity, i.e., $Dr=|Ds/Rs|$ degrees. If the storage capacity difference is a negative value, the control unit 12 calculates the rotation degree as 360 degrees subtracted from the absolute value, i.e., $Dr=360-|Ds/Rs|$ degrees. The control unit 12 calculates the runtime of the dial pointer 161 as the rotation degree divided by the reference mark, i.e., $Tr=Dr/5$ seconds.

The control unit 12 is operable to control the timer 14 to count incrementing a time value (denoted as "Tv") by one, i.e., $Tv=Tv+1$, when the dial pointer 161 runs one mark along the scale dial 160. The control unit 12 is operable to determine whether the runtime Tr is equal to the time value Tr, and generate an interrupt signal for shutting off the logical circuit 15 when the runtime Tr is equal to the time value Tr.

The logical circuit 15 is operable to output a high voltage (e.g., 5 Volts) to the quartz meter 16 to control the dial pointer 161 to run around the scale dial 160 when the enabling signal is received from the control unit 12. The logical circuit 15 is operable to output a low voltage (e.g., 0 Volts) to the quartz meter 16 to control the dial pointer 161 to stop running around the scale dial 160 when the interrupt signal is received from the control unit 12.

The quartz meter 16 is operable to control the dial pointer 161 to point to a mark of the scale dial 160 corresponding to the current storage capacity of the USB flash drive 1 when the quartz meter 16 receives the high voltage. Referring to FIG. 2, the quartz resonator 163 generates a pulsed magnetic field when quartz resonator 163 receives the high voltage. The dial pointer 161 points to the mark of the scale dial 160 corresponding to the current storage capacity of the USB flash drive 1 when the quartz resonator 163 controls the electromagnetic rotor 164 to rotate under the pulsed magnetic field. When the USB flash drive 1 is unplugged from the computing device, the dial pointer 161 always points to the mark of the scale dial 160 corresponding to the current storage capacity of the USB flash drive 1, see in FIG. 3. Therefore, a user can read the current storage capacity of the USB flash drive 1 according to the mark of the scale dial 160, so as to avoid plugging the USB flash drive 1 to the computing device before the user uses the USB flash drive 1 to store data.

Figure 4:
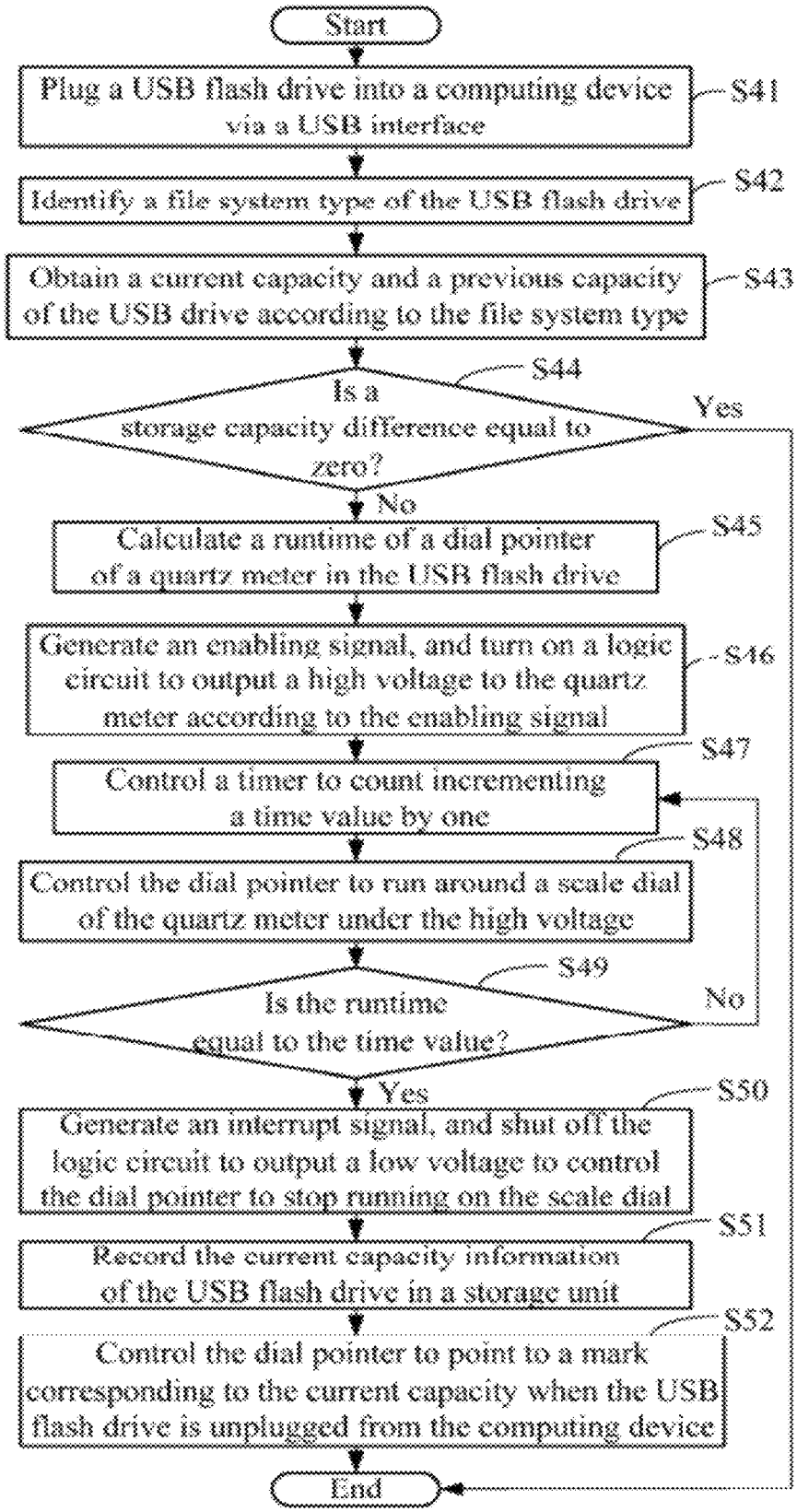
FIG. 4 is a flowchart of one embodiment of a method for determining available storage capacity of the USB flash drive in FIG. 1.

FIG. 4 is a flowchart of one embodiment of a method for determining available storage capacity of the USB flash drive 1 as described in FIG. 1. Depending on the embodiment, additional blocks may be added, others removed, and the ordering of the blocks may be changed.

In block S41, a user plugs the USB flash drive 1 into a computing device via the USB interface 11. In one embodiment, the computing device may be a personal computer (PC), or a digital camera, for example. In block S42, the control unit 12 identifies a file system type of the USB flash drive according to storage capacity information stored in the storage unit 13. As mentioned above, the file system type may be a type of FAT16, FAT32, NTFS, EXT2 or EXT3 file system. The storage capacity information may include a current storage capacity and a previous storage capacity of the USB flash drive 1. In block S43, the control unit 12 obtains the current storage capacity and the previous storage capacity of the USB flash drive 1 from the storage unit 13 according to the file system type.

In block S44, the control unit 12 calculates a storage capacity difference between the current storage capacity equals the previous storage capacity, and determines whether the storage capacity difference is equal to zero. If the storage capacity difference is equal to zero, block S45 implements. If the storage capacity difference is not equal to zero, the flow ends.

In block S45, the control unit 12 calculates a runtime (denoted as "Tr") of the quartz meter 16 according to a time calculation algorithm. As described in FIG. 2, the quartz meter 16 includes a scale dial 160, a dial pointer 161, a steering gear 162, a quartz resonator 163, and an electromagnetic rotor 164. As mentioned above, the time calculation algorithm is used to calculate the runtime of the dial pointer 161 when the dial pointer 161 runs around the scale dial 160.

In block S46, the control unit 12 generates an enabling signal, and turns on the logical circuit 15 to output a high voltage (e.g., 5 Volts) to the quartz meter 1 according to the enabling signal. In block S47, the control unit 12 controls the timer 14 to count incrementing a time value (denoted as "Tv") by one, i.e., Tv=Tv+1. In block S48, the control unit 12 controls the dial pointer 161 to run around the scale dial 160 when the quartz meter 16 receives the high voltage from the logical circuit 15. In block S49, the control unit 12 determines whether the runtime Tr is equal to the time value Tv. If the runtime Tr is equal to the time value Tv, block S50 implements. If the runtime Tr is not equal to the time value Tv, the flows returns to block S47.

In block S50, the control unit 12 generates an interrupt signal, and shuts off the logical circuit 15 to output a low voltage (e.g., 0 Volt) to the quartz meter 16 to control the dial pointer 161 to stop running around the scale dial 160 according to the interrupt signal. In block S51, the control unit 12 records the current capacity information of the USB flash drive 1 into the storage unit 13.

In block S52, the dial pointer 161 to point to a mark of the scale dial 160 corresponding to the current storage capacity of the USB flash drive 1 when the quartz meter 16 receives the high voltage. Referring to FIG. 2, the quartz resonator 163 generates a pulsed magnetic field when quartz resonator 163 receives the high voltage. The dial pointer 161 points to the mark of the scale dial 160 corresponding to the current storage capacity of the USB flash drive 1 when the quartz resonator 163 controls the electromagnetic rotor 164 to rotate under the pulsed magnetic field. When the USB flash drive 1 is unplugged from the computing device, the dial pointer 161 always points to the mark of the scale dial 160 corresponding to the current storage capacity of the USB flash drive 1, see in FIG. 3. Therefore, the user can read the current storage capacity of the USB flash drive 1 according to the mark of the scale dial 160, so as to avoid plugging the USB flash drive 1 to the computing device before the user uses the USB flash drive 1 to store data.

Although certain inventive embodiments of the present disclosure have been specifically described, the present disclosure is not to be construed as being limited thereto. Various changes or modifications may be made to the present disclosure without departing from the scope and spirit of the present disclosure.

What is claimed is:

1. A Universal Serial Bus (USB) flash drive, comprising:

a quartz meter comprising a scale dial and a dial pointer;

a timer operable to count a time value when the dial pointer runs around the scale dial;

a storage unit operable to store a file system that records storage capacity information of the USB flash drive;

a control unit operable to obtain a current storage capacity and a previous storage capacity of the USB flash drive according to the storage capacity information, calculate a storage capacity difference between the current storage capacity and the previous storage capacity, calculate a runtime of the dial pointer according to a time calculation algorithm when the dial pointer points to a mark of the scale dial corresponding to the current storage capacity, generate an enabling signal if the storage capacity difference is not equal to zero, and generate an interrupt signal when the runtime equals the time value; and a logic circuit operable to output a high voltage to the quartz meter to control the dial pointer to run around the scale dial when the enabling signal is received from the control unit, and output a low voltage to the quartz meter to control the dial pointer to stop running on the scale dial when the interrupt signal is received from the control unit.

2. The USB flash drive according to claim 1, wherein the scale dial is positioned on the surface of the USB flash drive, and comprises a plurality of marks.

3. The USB flash drive according to claim 2, wherein each of the marks corresponds to a storage capacity value of the USB flash drive.

4. The USB flash drive according to claim 1, wherein the quartz meter further comprises a steering gear, a quartz resonator, and an electromagnetic rotor.

5. The USB flash drive according to claim 4, wherein the quartz resonator generates a pulsed magnetic field to control the electromagnetic rotor to rotate when the quartz resonator is under the high voltage.

6. The USB flash drive according to claim 4, wherein the dial pointer rotates to any mark on the scale dial when the steering gear is driven to rotate by the electromagnetic rotor.

7. The USB flash drive according to claim 1, wherein the time calculation algorithm comprises:

calculating a reference storage capacity and a reference mark of the scale dial when the dial pointer rotates one degree around the scale dial;

determining whether the storage capacity difference is a positive value or a negative value;

calculating a rotation degree of the dial pointer as a absolute value of the storage capacity difference divided by the reference storage capacity, if the storage capacity difference is a positive value; or calculating the rotation degree as 360 degrees subtracted from the absolute value, if the storage capacity difference is a negative value; and calculating the runtime of the dial pointer as the rotation degree divided by the reference mark.

8. A method for determining a storage capacity of a Universal Serial Bus (USB) flash drive, the USB flash drive comprising an USB interface, a control unit, a storage unit, a timer, a logic circuit, and a quartz meter having a scale dial and a dial pointer, the method comprising:

(a1) plugging the USB flash drive into a computing device via the USB interface;

(a2) obtaining a current storage capacity and a previous storage capacity of the USB flash drive according to storage capacity information stored in the storage unit;

(a3) calculating a storage capacity difference between the current storage capacity and the previous storage capacity;

(a4) calculating a runtime of the dial pointer according to a time calculation algorithm if the storage capacity difference is not equal to zero;

(a5) generating an enabling signal by the control unit, and turning on the logical circuit to output a high voltage to the quartz meter according to the enabling signal;

(a6) controlling the timer to count incrementing a time value by one;

(a7) controlling the dial pointer to run around the scale dial when the quartz meter receives a high voltage from the logical circuit;

(a8) determining whether the runtime is equal to the time value;

(a9) generating an interrupt signal by the control unit, and shutting off the logical circuit to output a low voltage to the quartz meter if the runtime is equal to the time value, or repeating the block (a6) to the block (a8) if the runtime is not equal to the time value;

(a10) controlling the dial pointer to stop running around the scale dial according to the low voltage when the interrupt signal is received from the control unit; and (a11) controlling the dial pointer to point to a mark of the scale dial corresponding to the current storage capacity when the USB flash drive is unplugged from the computing device.

9. The method according to claim 8, further comprising:

identifying a file system type of the USB flash drive according to the storage capacity information stored in the storage unit; and recording the current capacity information of the USB flash drive into the storage unit.

10. The method according to claim 8, wherein the scale dial is positioned on the surface of the USB flash drive, and comprises a plurality of marks.

11. The method according to claim 10, wherein each of the marks corresponds to a storage capacity value of the USB flash drive.

12. The method according to claim 8, wherein the quartz meter further comprises a steering gear, a quartz resonator, and an electromagnetic rotor.

13. The method according to claim 12, wherein the quartz resonator generates a pulsed magnetic field to control the electromagnetic rotor to rotate when the quartz resonator is under the high voltage.

14. The method according to claim 12, wherein the dial pointer rotates to any mark on the scale dial when the steering gear is driven to rotate by the electromagnetic rotor.

15. The method according to claim 8, wherein the time calculation algorithm comprises:

calculating a reference storage capacity and a reference mark of the scale dial when the dial pointer rotates one degree around the scale dial;

determining whether the storage capacity difference is a positive value or a negative value;

calculating a rotation degree of the dial pointer as a absolute value of the storage capacity difference divided by the reference storage capacity, if the storage capacity difference is a positive value; or calculating the rotation degree as 360 degrees subtracted from the absolute value, if the storage capacity difference is a negative value; and calculating the runtime of the dial pointer as the rotation degree divided by the reference mark.

* * * * *